United States Patent [19]

Turner et al.

[11] Patent Number: 4,673,041

[45] Date of Patent: Jun. 16, 1987

[54] CONNECTOR FOR WELL SERVICING SYSTEM

[75] Inventors: William H. Turner, Chester, England; Ivan K. Slaughter, Montrose, Scotland

[73] Assignee: Otis Engineering Corporation, Dallas, Tex.

[21] Appl. No.: 829,614

[22] Filed: Feb. 14, 1986

Related U.S. Application Data

[63] Continuation-in-part of Ser. No. 663,476, Oct. 22, 1984.

[51] Int. Cl.[4] ..... E21B 43/01

[52] U.S. Cl. ..... 166/340; 166/344; 166/356

[58] Field of Search ..... 166/338, 340, 344, 352, 166/355, 356, 360, 363, 364, 365

[56] References Cited

U.S. PATENT DOCUMENTS

| | | | |
|---|---|---|---|
| 3,556,209 | 1/1971 | Reistle, III | 166/352 |
| 3,621,912 | 11/1971 | Woody, Jr. et al. | 166/340 |
| 4,436,451 | 3/1984 | Anderson | 166/355 |
| 4,577,693 | 3/1986 | Glaser | 166/338 |

*Primary Examiner*—Stephen J. Novosad
*Assistant Examiner*—William P. Neuder
*Attorney, Agent, or Firm*—Roland O. Cox

[57] ABSTRACT

A remotely operable connector having releasably connectable male and female members. The male member sealingly engages the female member on connection. The female member houses radially moveable dogs which may be locked in connecting engagement in a groove on the male connector by a lock sleeve longitudinally moveable over the dogs. The sleeve, which is biased to dogs locked position, moves to dogs unlocked position in response to pressure applied to a first inlet and may be retained in dogs locked position by continued application of pressure to a second inlet. The female connector houses a pressure lock which prevents movement of the lock sleeve from locked position on application of pressure to the first inlet, if there is pressure in the connector bore. The connector is unlocked for disconnect when there is no pressure in the connector bore and pressure is applied through the first inlet, moving the sleeve to dogs unlocked position. This connector is particularly useful in a disclosed underwater well wireline servicing system, as a wellhead connector or lubricator section connector. The well servicing system provides wireline well servicing of underwater wells without pollution of surrounding water and for emergency disconnect from the underwater wellhead for quick floating service vessel removal.

26 Claims, 6 Drawing Figures

CONNECTOR FOR WELL SERVICING SYSTEM

This application is a continuation-in-part of our copending application for Letters patent, Ser. No. 663,476, filed 22 of Oct., 1984.

BACKGROUND

This invention relates to devices for releasably connecting tubular members and well servicing equipment. The invention particularly relates to a remotely actuated connector especially useful in an underwater well servicing system.

A number of remotely actuated connectors have been developed and are being used during well servicing operations. These remotely actuated connectors eliminate manual connector operation and repeated requirements for expensive divers when releasably connecting well servicing equipment components together or to and from underwater wellheads.

One of these devices is described in an article entitled "Latch System Speeds Stem Results" on page 43 of the February, 1984 issue of "Drilling Contractor" magazine, which is published in Houston, Tex.

Examples of two riser connectors, remotely operated by shifting tools and used underwater in ocean floor well operations, are disclosed in U.S. Pat. Nos. 4,307,902 and 4,411,455 to Schnatzmeyer. An example of a hydraulically actuated connector which may be remotely actuated is shown in U.S. Pat. No. 4,337,971 to William D. Kendrick. These connectors can be disconnected with pressure in the connector bore, resulting in possible loss of pressure control of the well and serious disaster.

An example of a wireline well servicing system, utilizing a riser latched to the wellhead is shown in an article, "MSV completes wireline job At minimum cost," on pp. 69 and 70 of the August 1985, issue of Ocean Industry magazine, published by Gulf Publishing Company, P.0. Box 2608, Houston, Tex. 77001. In this article, wireline tools were "introduced through a deck level lubricator" and the complete riser remains latched to the wellhead until all wireline work is completed.

The underwater well wireline servicing system disclosed in the previously mentioned parent application and completely disclosed in this application was the subject of technical paper number SPE 13975/1, entitled "The British Argyll DSV Wirelining System," which was presented at the Offshore Europe, 85 Conference in conjunction with the Society of Petroleum Engineers of AIME in Aberdeen, Scotland, 10–13 Sept., 1985 and published by Society of Petroleum Engineers of AIME, P.0. Box 833836, Richardson, Tex. 75083-3836.

SUMMARY OF THE INVENTION

The connector of this invention provides a remotely operable connector having male and female members, one of which may be connected to each servicing equipment component or wellhead to be releasably connected to. Pressure may be selectively applied from a remote source to inlets in the female member to move a longitudinally moveable sleeve and position this member in released or locked position. An additional lock, responsive to pressure in the female connector bore, prevents the longitudinally moveable sleeve from being moved by remote pressure, positively preventing intentional or unintentional release and disconnect of the connector when there is pressure in the female connector bore. Once the connector members are in place, the connector may be operated remotely to easily, quickly and repeatedly connect and disconnect the well servicing equipment components to and from each other or the wellhead of the well being serviced.

The connector of this application is particularly useful in an underwater wireline well servicing system utilizing a lubricator stack, including upper and lower sections, connected by the remotely operable connector of this application or another remotely operated connector to provide quick disconnect of the upper lubricator section for retrieval of the section and wireline tool string back to the service vessel while performing wireline operations in the well or for emergency disconnect and floating vessel removal. Use of the application connector would prevent inadvertent remote operation to disconnect the sections resulting in pollution and possible loss of well control when there is internal pressure in the connected lubricator sections. If desired, the lubricator stack may include a flushing system, useful in removing undesirable fluids from within the stack for controlled disposal.

The lower lubricator stack section includes a manual or remotely operable wellhead connector and the male or female member of a remotely operable section connector. The lower lubricator section may include one or more lubricator sections, with or without a connected remotely operable flush valve, a remotely operable annular blowout preventer and a remotely operable wireline blowout preventer or fail close type wireline blowout preventer.

The upper lubricator stack section includes a remotely adjustable stuffing box, one or more lubricator sections, with or without a connected remotely operable flush valve, and a male or female member of the section connector, connectable to the lower section connector member. The upper lubricator stack section may also include a remotely operable tool catcher and/or a remotely operable tool trap and a remotely operable liquid chamber to lubricate the wireline.

The floating service vessel needed to operate the wireline servicing system should have on deck a wireline service unit, which includes a line winch, a wireline winch with constant wireline tensioning capabilities, a vessel heave compensator, a source of pressured fluid, a source of pressured gas and a handling system capable of assembling, disassembling and deploying the lower and upper lubricator stacks.

An object of this invention is to provide a connector operable to connect and disconnect from a remote pressure source.

Another object of this invention is to provide a remotely operable connector, which may be locked connected by continued application of pressure.

Also an object of this invention is to provide a connector which cannot be disconnected, either intentionally or unintentionally, when there is pressure in the connector bore.

Another object of this invention is to provide a system for wireline servicing of underwater wells not requiring an expensive semi-submersible vessel equipped with a drilling rig and not requiring a tensioned riser tied back to the surface vessel.

An object of this invention is to provide a wireline well servicing system for underwater wells which includes a lubricator stack having a remotely operable connector for rapid emergency disconnect of the upper lubricator stack section.

Also an object of this invention is to provide an underwater well servicing system which prevents leakage of well fluids into and pollution of the surrounding water.

DESCRIPTION OF THE PREFERRED EMBODIMENTS

Figure 1:
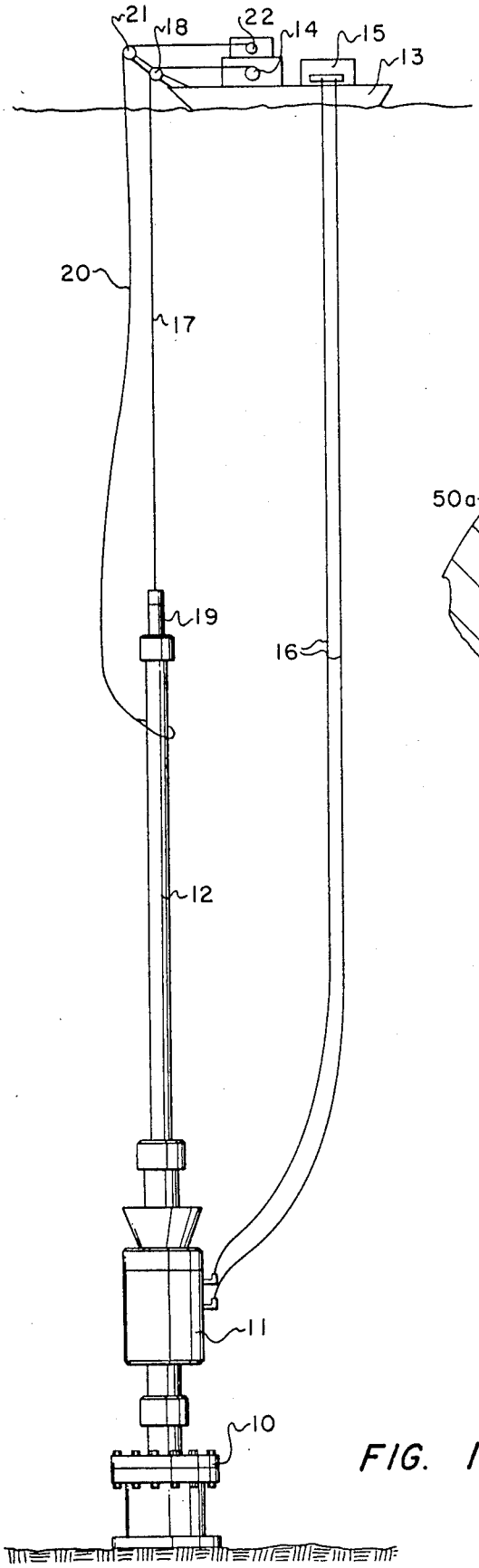
FIG. 1 is a schematic drawing of a basic underwater well servicing system, utilizing the wellhead connector invention of this application.

FIG. 1 shows schematically an ocean floor wellhead 10, utilizing a remotely operable connector 11 of this invention to connect a lubricator 12 to the wellhead for servicing the well. A service vessel 13, on the surface, has a wireline service unit mounted on deck which includes a wireline reel 14 and a pressure source 15. Hoses 16 connected to the pressure source and the invention connector, conduct pressured fluid between the pressure source and connector. A wireline 17 is connected to the reel and passes over a sheave 18 and through a stuffing box to a wireline tool string (not shown) in the lubricator. A handling line 20, attached to the lubricator, passes over a line sheave 21 and is connected to a line winch 22 on the vessel. After connecting a connector member to the wellhead and a connector member to the lubricator or other well servicing equipment, the lubricator may be lowered and the connector operated remotely to connect or disconnect and raise the lubricator or other well servicing equipment back to the service vessel as often as required during well servicing operations.

Figure 2:
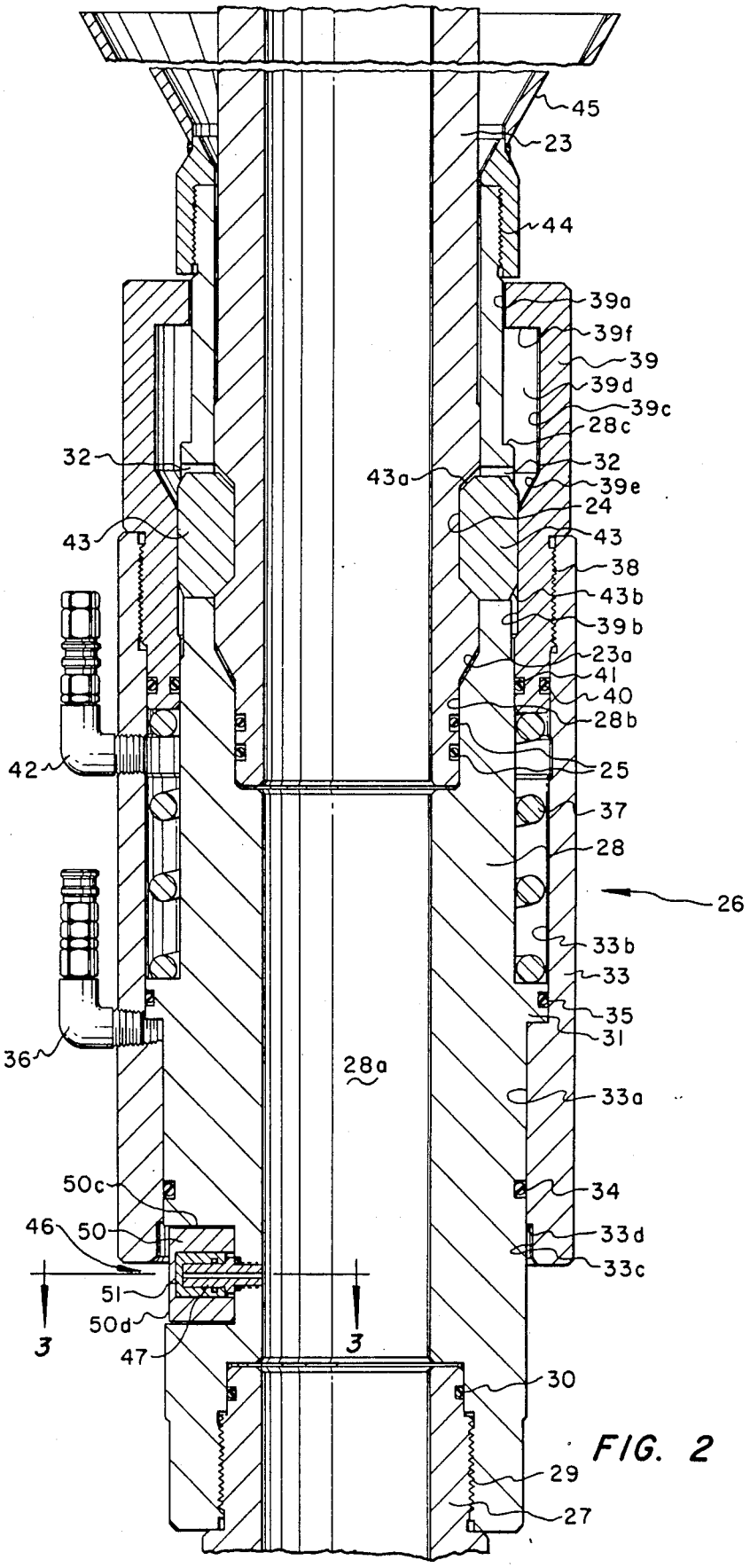
FIG. 2 is a sectioned drawing of the connector of this invention showing the members of the connector connected.

The invention connector 11 shown in FIG. 2 includes a male member 23, having an appropriate connection on its upper end for connection to well servicing equipment to be connected to the wellhead or other equipment. The male member has an external groove 24, a cam surface 24*a*, and houses resilient seals 25 in grooves near its lower end. An external camming surface 23*a* is provided between the resilient seals and groove.

The female connector member 26 includes a lower body 27 which has an appropriate connection on its lower end to connect the female member to the wellhead or other equipment. The upper end of the lower body is connected to body 28 with thread 29 and sealed to the body with resilient seal 30. The body has a through bore 28*a*, a seal bore 28*b*, a shoulder 28*c*, an external flange 31, and openings 32. A longitudinally moveable sleeve 33 is mounted around the lower portion of the body and the flange and has seal bores 33*a* and 33*b*. Bore 33*a* is slidably sealed to the body with resilient seal 34 and bore 33*b* is slidably sealed to the flange with resilient seal 35. The lower end of the sleeve has a counterbore 33*c* which forms a shoulder 33*d* with bore 33*a*. The sleeve is fitted with an inlet 36, which is connected to a conduit, to conduct control fluid from a remote pressure source to act on the sealed annular area between resilient seals 34 and 35. Mounted around the body in sleeve bore 33*b* is a spring 37.

Mounted around body 28 and connected to the upper end of the sleeve with threads 38 is a lock sleeve 39, which is sealed to the sleeve with resilient seal 40 and slidably sealed to the body with resilient seal 41. The lock sleeve retains spring 37 in bore 33*b* and has bores 39*a*, 39*b*, and 39*c*, which form an internal recess 39*d* in the lock sleeve. A conical surface 39*e*, connects bores 39*b* and 39*c* and shoulder 39*f* extends from bore 39*a* to bore 39*c*. Sleeve 33 is fitted with another inlet 42, which is connectable to a conduit, to conduct control fluid from a remote pressure source to act on the annular area between seals 35 and 41.

Mounted for radial movement in each body opening 32, is a lug 43 having camming surfaces 43*a*, 43*b* and 43*c*. Connected to the upper end of the female connector body 28 with threads 44 is a frusto-conical guide 45, useful to guide the male member into the female member for connection.

Figure 3:
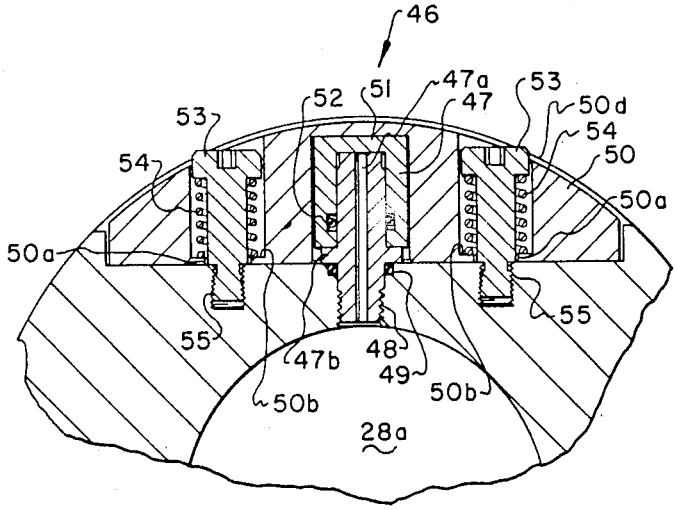
FIG. 3 is a drawing of a fragment of a section along lines 3—3 of FIG. 2.

Housed in a recess in the lower wall of body 28 is a connector lock 46. As shown by FIG. 3, the lock includes a rod 47 with a through flow passage 47*a* and an external flange 47*b*. The rod is connected in the wall recess to body 28 with thread 48 and one end of flow passage 47*a* in communication with body bore 28*a*. The rod is sealed to the body with resilient seal 49. Mounted over the rod in a recess in sleeve stop 50 is a piston 51, slidably sealed to the rod with resilient seal 52. Any pressure in bore 28*a* may act through flow passage 47*a* on the area sealed by seal 52. The sleeve stop has through holes 50*a* with internal shoulders 50*b*. Additionally, the stop has a side surface 50*c* and an arcuate surface 50*d*. The diameter of surface 50*d* is very slightly less than the diameter of bore 33*c*. Mounted around a shoulder screw 53 in each hole is a spring 54 and each screw is connected to the bottom of the body wall recess by threads 55.

Figure 4:
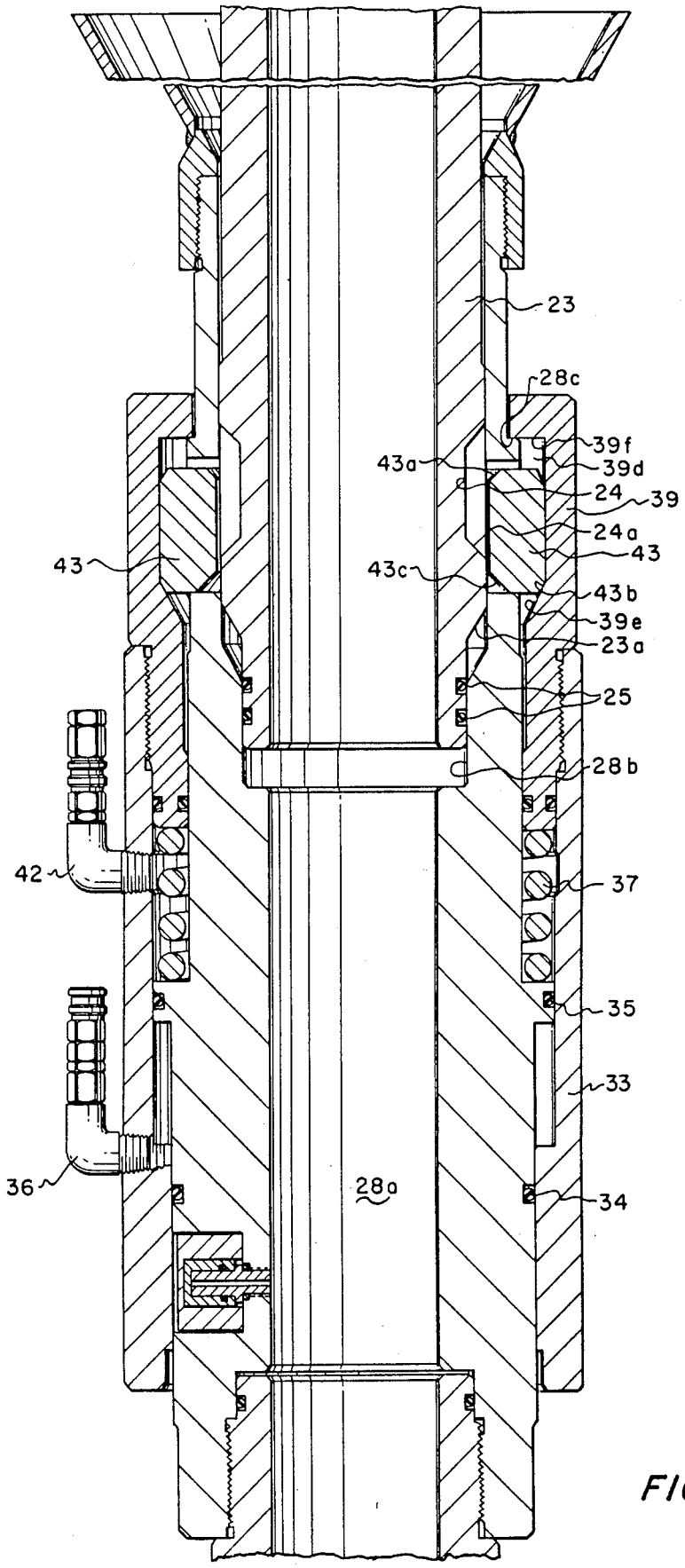
FIG. 4 is a sectioned drawing of the connector of this invention, showing the members released and partially disconnected.

To utilize the connector of this invention and connect the male and female members, as shown in FIG. 2, the male member 23 is connected to the lower end of the equipment to be connected to the wellhead and the female member 26 is connected to the wellhead. If desirable, this connector may be inverted and the male member attached to the wellhead. It should be obvious that the connector of this invention is useful to connect pipes, cylindrical shapes and the like, and is operable in air or under water in any attitude. After connecting the male member, equipment with male member is lowered into guide 45. Pressure is then applied from the remote pressure source through the conduit and inlet 36 to act on the annular sealed area between seals 34 and 35. Sufficient pressure on this area will move sleeves 33 and 39 downwardly, compressing spring 37, until lock sleeve shoulder 39*f* contacts body shoulder 28*c* and recess 39*d* is beside dogs 43, as shown in FIG. 4. As the male member is lowered further, camming surface 23*a* may contact surface 43*a* on lugs 43 and move the lugs out into lock sleeve recess 39*d*, clearing the way for male member seals 25 to travel down and sealingly engage body seal bore 28*b*, and position groove 24 inside the lugs.

Now, pressure at inlet 36 is reduced until spring 37 moves sleeves 33 and 39 upwardly until lock sleeve surface 39*e* contacts dog surface 43*b* and cams lugs 43 radially in from recess 39*d* and into engagement with male member groove 24. 0n continued upward movement of sleeve 39, bore 39*b* moves up over the lugs, locking them engaged in groove 24, and the male and female connector members connected. If desired, pressure may now be applied through inlet 42 to act on the sealed annular area between seals 35 and 41 to prevent any downward movement of sleeves 39 and 33 and retain the connector connected and locked connected.

To unlock and disconnect the connector of this invention, when there is no pressure in body bore 28*a*, pressure in inlet 36 is increased sufficiently to compress spring 37 and move sleeves 33 and 39 downwardly until lock sleeve recess 39*d* is outside lugs 43. At that time, male member 23 may be lifted disengaging seals 25 from body bore 28*b*, until groove cam surface 24*a* contacts lug surface 43*c*. Further upward movement of the male member will cam lugs 43 into lock recess 39*d*, as shown in FIG. 4 and permit the male member 23 to be freely lifted and disconnected from female member 26.

Figure 5:
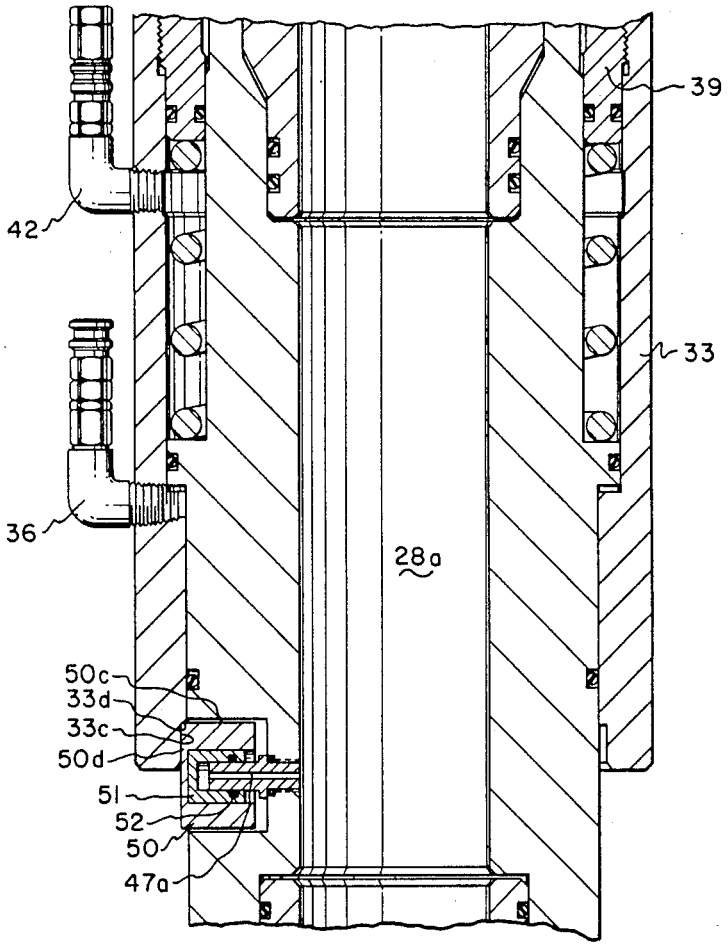
FIG. 5 is a fragment of drawing FIG. 2, showing the connector lock actuated.

When there is about 100 psi or more pressure in body bore 28*a*, the connector cannot be unlocked and disconnected even if pressure is increased in inlet 36 to move sleeves 33 and 39 downward to unlock the connector. Pressure in bore 28*a* acts through flow passage 47*a* on the area sealed by seal 52 and urges piston 51 and sleeve stop 50 to move out of the body wall recess and compress springs 54. A pressure of about 100 psi or more in bore 28*a* is sufficient to move the sleeve stop outwardly until stop surface 50*d* contacts sleeve bore 33*c*, as shown in FIG. 5. After sleeve shoulder 33*d* contacts stop surface 50*c* no further downward movement of sleeves 33 and 39 may occur even if pressure is applied in inlet 36 and the connector cannot be unlocked and disconnected until pressure in bore 28*a* is reduced to below about 100 psi, and springs 54 move piston 51 and stop 50 back into the body wall recess, disengaging shoulder 33*d* and surface 50, and allowing sleeve bore 33*a* to be moved downwardly over sleeve stop 50.

Figure 6:
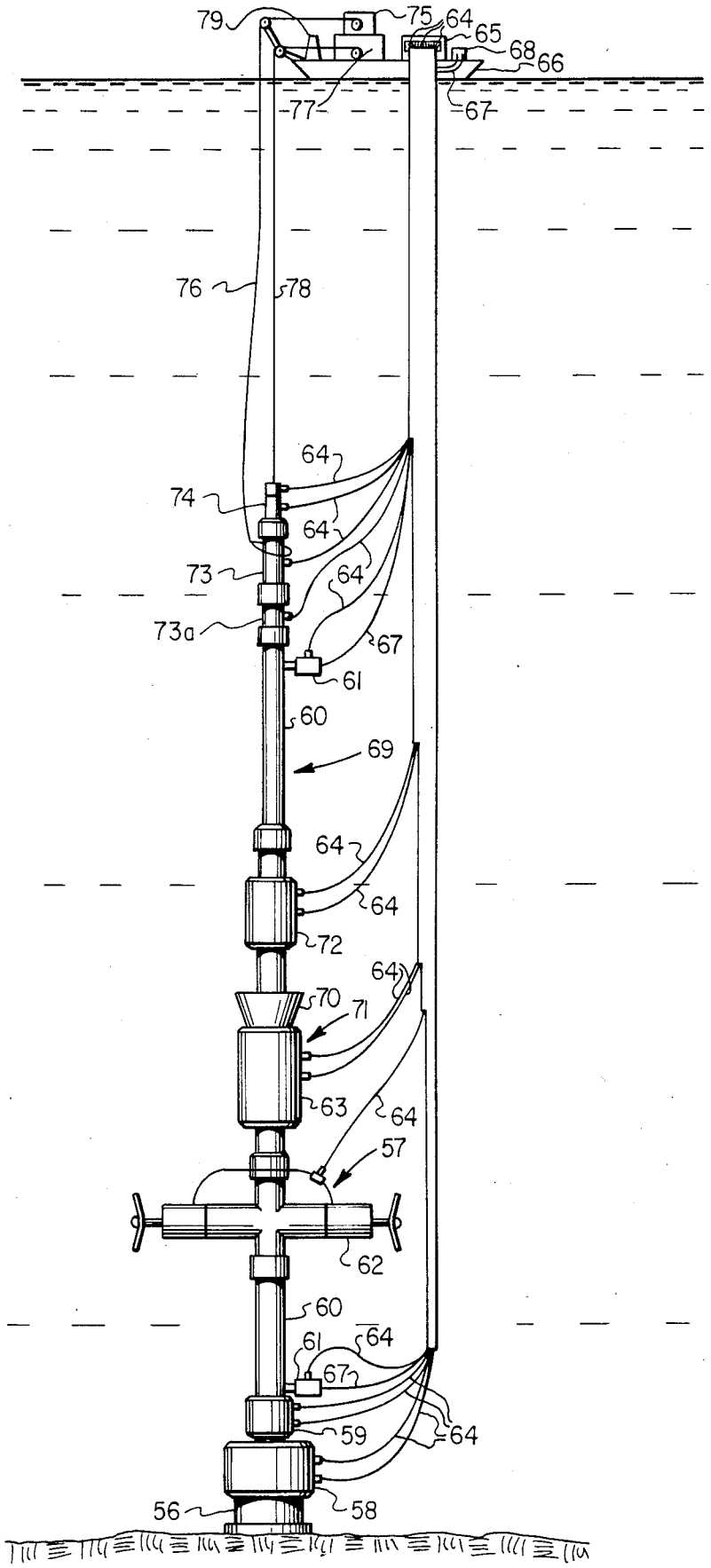
FIG. 6 is a schematic drawing showing the basic well servicing system of FIG. 1 with a complete complement of lubricator stack and floating service vessel equipment.

The basic well servicing system shown in FIG. 1 utilizes a simple lubricator stack having only a minimum number of components necessary for performing wireline service work in an underwater well. FIG. 6 shows the lubricator stack of FIG. 1 including more components, which provide greater benefits and safety for an underwater well servicing system. FIG. 6 shows a preferred more complete wireline well servicing system wherein a lubricator stack is connected to an underwater wellhead 56 and has a lower section 57, which includes a remotely operable wellhead connector 58, an annular type blowout preventer 59, at least one lubricator section 60, a remotely operable flush valve 61, connected to communicate with the lubricator section bore, a fail close wireline type blowout preventer 62 of U.S. Pat. No. 4,214,605 and the female member 63 of the remotely operable lubricator section connector 71 disclosed in this application. A number of control conduits 64 are connected to each remotely operable lower section component and a source of pressured fluid 65 on the floating service vessel 66, positioned above the wellhead. The flush valve 61 has a conduit 67, which is connected to a source of pressured gas 68 on the floating vessel.

Those skilled in well servicing art will recognize a manual wellhead connector, a lubricator section without a flush valve and a remotely operable wireline blowout preventer not having the fail close feature could be used in the lower lubricator section 57.

The upper lubricator section 69 includes the male member 70 of the remotely operable lubricator section connector 71 of this application, a remotely operable tool trap 72, at least one lubricator section 60 having a flush valve 61, connected to communicate with the lubricator section bore, a remotely operable tool catcher 73, a remotely operable wireline stuffing box 74 and a remotely operable liquid chamber 73*a*. Control conduits 64 furnish pressured fluid to the remotely operable components in the upper lubricator section and conduit 67 conducts pressured gas to the upper section flush valve.

Again, those skilled in well servicing art would recognize a lubricator section without a connected flush valve could be used in the upper section and another remotely operable connector could be used to connect the upper and lower lubricator sections.

Mounted on the floating service vessel 66 is a wireline service unit having a line winch 75 on which a line 76 is reeled. While FIGS. 1 and 6 show the wireline service unit supported by a vessel floating on the surface, those skilled in this art would readily understand that the service unit could as well be supported by any platform on the surface. The line and winch are useful to lower and raise the lubricator stack and sections to and from the underwater wellhead. Also on the floating vessel is a wireline winch 77 on which wireline 78 is reeled and a vessel heave compensator 79 for the wireline. The wireline is threaded through the heave compensator, around a sheave and through stuffing box 74 and is connected to a wireline tool string in upper lubricator section 69. The wireline winch provides constant wireline tensioning and is used to lower and raise the wireline and tool string to perform operations in the well.

To use the underwater wireline servicing system, a properly equipped surface platform or floating service vessel 66 is first positioned above the underwater wellhead 56. Required pressured liquid and gas conduits 64 and 67 are connected to components in the lower lubricator stack section 57 and the lower section is lowered by line 76 and line winch 75 from the floating service vessel to the underwater wellhead and connected. On the deck of the service vessel, the wireline 78 is threaded through the vessel heave compensator 79 and the upper lubricator stack section stuffing box 74 and connected to the wireline tool string. The tool string is pulled into the upper stack section. Required pressured gas and fluid conduits 67 and 64 are connected to the upper lubricator stack section components and the upper section 69 is lowered to the underwater wellhead 56 with the line winch and connected to the lower lubricator section with section connector 71. If desired the lower and upper lubricator stack sections may be connected by connector 71 before being lowered and connected to the wellhead.

Wireline operations are then conducted in the well. During wireline operations, the stuffing box 74 may be remotely operated to seal around wireline 78 as required and the section connector 71 may be operated to disconnect the upper lubricator section 69 for raising it with connected conduits and the wireline tool string back to the vessel deck and to reconnect the upper section to the lower lubricator section 57 on lowering the upper section back to female connector 63 and connecting male section member 70 therein.

If the section connector 71 has a pressure responsive lock, internal pressure must be bled from the lubricator stack before the section connector can be operated to disconnect. If the lower section includes a remotely operable wireline blowout preventer 62, this preventer would be operated as required during wireline operations. If a rapid disconnect is required for service vessel removal, the wireline blowout preventer 62 is closed and the section connector is operated to disconnect the upper lubricator section from the lower section, so the upper section can be raised back to the service vessel with connected conduits and wireline tool string inside. Conduits connected to the lower lubricator section are cut by operating power shear devices on the service vessel, freeing the vessel to be moved. If a fail close type wireline blowout preventer is used in the lower lubricator section, well pressure closes it automatically on loss of control pressure in conduit 64, closing and maintaining pressure control of the well.

If the lower lubricator section includes a remotely operable wellhead connector 58, this connector would be remotely operated as required to connect the lower lubricator section 57 to and disconnect it from the wellhead 56. The connector of this application with a pressure responsive connector lock could be used as a wellhead connector.

If the lubricator stack includes a flushing system, the flush valves 61 may be selectively operated to introduce pressured gas from source 68 through conduits 67 for controlled flushing of hydrocarbons from the lubricator stack into the well flowline or back down the well to prevent release of pollutants into the surrounding water when disconnecting the lubricator sections.

If the lower lubricator section includes a remotely operated annular type blowout preventer 59, this preventer would be operated to close as required while performing wireline operations.

If the upper lubricator stack includes a remotely operable tool trap 72 and/or tool catcher 73, these tools would also be operated if the need arises, while performing wireline work in a well.

After completion of wireline operations, the upper lubricator section 69 with conduits 64 and 67 and wireline tool string inside is disconnected at section connector 71 and raised back to the service vessel with the line and wireline winches. The lower lubricator section 57 with conduits 64 and 67 is then disconnected from the wellhead 56 and raised back to the service vessel 66 with the line winch 75.

We claim:

1. A system for conducting wireline operations in an underwater well comprising:

(a) lubricator stack means, connectable to the wellhead and having a wireline tool string therein, comprising:

a lower section including a remotely operable section connector member and means for connecting said lower section to a wellhead, an upper section including a remotely operable section connector member connectable to said lower section connector member, one or more lubricator sections and a remotely operable stuffing box (b) a floating vessel having mounted thereon line winch means for lowering and raising said lubricator stack means, wireline winch means for operating said wireline tool string in the well, a source of pressured fluid; and (c) control conduits for conducting pressured fluid from said source to one of said remotely operable section connector members and to said stuffing box.

2. The system as defined in claim 1 further including means for flushing the lubricator stack means comprising:

a remotely operable flush valve connected in the upper and lower lubricator stack sections, each said valve having a control conduit conducting pressured fluid from the pressure source to said valves, a source of pressured gas on the floating vessel, and a conduit for conducting pressured gas from said source to the flow passage through each said valve.

3. The system as defined in claim 1 wherein the means for connecting the lower lubricator stack section to the wellhead is a remotely operated wellhead connector having control conduits for conducting pressured fluid from the pressure source to said wellhead connector.

4. The system as defined in claim 3 wherein the remotely operated wellhead connector includes means responsive to internal stack means pressure for locking said connector connected.

5. The system as defined in claim 1 wherein the connected section connector members have means responsive to internal stack means pressure for locking said connector members connected.

6. The system as defined in claim 1 wherein the wireline winch means provides constant tensioning for the wireline.

7. The system as defined in claim 1 further including a vessel heave compensator for the wireline, mounted on the floating vessel.

8. The system as defined in claim 1 wherein the lower lubricator stack section further includes a remotely operable annular blowout preventer having control conduits for conducting pressured fluid from the pressure source to said preventer.

9. The system as defined in claim 1 wherein the lower lubricator stack section further includes a remotely operable wireline type blowout preventer having control conduits for conducting pressured fluid from the pressure source to said preventer.

10. The system as defined in claim 1 wherein the lower lubricator stack section further includes a remotely operable fail close type wire line type blowout preventer having a control conduit for conducting pressured fluid from the pressure source to said preventer.

11. The system as defined in claim 1 wherein the lower lubricator stack section includes one or more lubricator sections.

12. The system as defined in claim 1 wherein the upper lubricator stack section includes a remotely operable tool trap having control conduits for conducting pressured fluid from the pressure source to said trap.

13. The system as defined in claim 1 wherein the upper lubricator stack section includes a remotely operable tool catcher having control conduits for conducting pressured fluid from the pressure source to said catcher.

14. A system for conducting wireline operations in an underwater well comprising:

(a) lubricator stack means comprising:

a lower section including a remotely operable wellhead connector, a remotely operable annular blowout preventer, one or more lubricator sections, a remotely operable flush valve connected low in said lubricator section,
a remotely operable fail closed wireline blowout preventer, and
a remotely operable section connector member;
an upper section including
a remotely operable section connector member connectable to said lower section connector member,
a remotely operable tool trap, one or more lubricator sections,
a remotely operable flush valve connected high in said lubricator section,
a remotely operable tool catcher,
a remotely operable wireline stuffing box and a remotely operable liquid chamber
(b) a floating vessel having mounted thereon
a line winch for lowering and raising said lubricator stack means,
a constant tensioning wireline winch for operating a wireline tool string in the well,
a vessel heave compensator for the wireline,
a source of pressured gas, and
a source of pressured fluid;
(c) a conduit for conducting pressured gas from said gas source to each said flush valve; and
(d) control conduits for conducting pressured fluid from said fluid source to said remotely operable components in said lubricator stack.

15. The system as defined in claim 14 wherein one section connector member includes means responsive to internal stack means pressure for locking said section connector members connected.

16. The system as defined in claim 14 wherein the wellhead connector includes means responsive to internal stack means pressure for locking the wellhead connector connected.

17. A method for conducting wireline operations in an underwater well comprising the steps of:
(a) placing a wireline tool string in a lubricator stack including a wellhead connector, a remotely operable connector, at least one lubricator section and a remotely operable wireline stuffing box;
(b) passing a wireline through said stuffing box and connecting said wireline to said tool string;
(c) lowering the lubricator stack with line winch means from a floating vessel to an underwater wellhead;
(d) connecting the wellhead connector to the wellhead;
(e) raising and lowering the wireline with wireline winch means from said floating vessel to perform operations in the well;
(f) remotely operating the stuffing box to seal around the wireline;
(g) remotely operating the remotely operable connector to disconnect and reconnect said lubricator section and stuffing box from and to the wellhead connector to perform operations in the well; and
(h) disconnecting the wellhead connector from the wellhead and lifting said lubricator stack back to the floating vessel.

18. The method of claim 17 further including passing the wireline through a vessel heave compensator before passing the wireline through the remotely operable stuffing box.

19. A method for conducting wireline operations in an underwater well comprising the steps of:
(a) lowering the lower section of a lubricator stack, which includes a wellhead connector and a remotely operable section connector member, with a line and line winch means from a floating vessel to an underwater wellhead;
(b) connecting the lower section wellhead connector to the wellhead;
(c) placing a wireline tool string in an upper lubricator stack section, said section including a remotely operable section connector member, at least one lubricator section and a remotely operable stuffing box;
(d) passing a wireline through said stuffing box and connecting said wireline to said tool string;
(e) lowering the upper section with the line winch means to the lower section;
(f) connecting the upper section to the lower lubricator stack section, by connecting the section connector members;
(g) raising and lowering the wireline and toolstring with wireline winch means on the floating vessel, to perform operations in the well;
(h) remotely operating the stuffing box to seal around the wireline;
(i) remotely operating the lubricator section connector to disconnect the upper lubricator section from the lower section and lowering and raising said upper section and tool string therein back to the floating vessel and reconnecting said upper section to the lower lubricator section as required, while performing wireline operations in the well;
(j) disconnecting the upper section from the lower section and raising the upper section and tool string back to the floating vessel; and
(k) disconnecting the lower section from the wellhead and raising the lower section back to the floating vessel.

20. The method of claim 19 further including passing the wireline through a vessel heave compensator before passing the wireline through the stuffing box.

21. A method for conducting wireline operations in an underwater well comprising the steps of:
(a) lowering the lower section of a lubricator stack with a line and line winch means from a floating vessel to an underwater wellhead, said lower section including
a remotely operable wellhead connector,
a remotely operable annular blowout preventer, one or more lubricator sections,
a remotely operable flush valve connected low in the lubricator section,
a remotely operable fail close wireline blowout preventer, and
a remotely operable section connector member;
(b) connecting the lower section wellhead connector to the wellhead;
(c) placing a wireline tool string in an upper lubricator stack section, said section including
a remotely operable section connector member,
a remotely operable tool trap, one or more lubricator sections,
a remotely operable flush valve connected high in said lubricator section,
a remotely operable tool catcher,
a remotely operable stuffing box and a remotely operable liquid chamber;
(d) passing a wireline through said stuffing box and connecting said wireline to said tool string;

(e) lowering the upper section with the line winch means to the lower section;

(f) connecting the upper section to the lower lubricator stack section by connecting the section connector members, said section connector including means responsive to internal lubricator stack pressure for locking said connector members connected;

(g) raising and lowering the wireline and toolstring with a constant tensioning wireline winch from the floating vessel to perform wireline operations in the well;

(h) remotely operating the remotely operable components in the lubricator stack and flushing the lubricator stack as required, while performing wireline operations in the well;

(i) bleeding pressure from the lubricator stack to unlock the section connector;

(j) remotely operating the lubricator section connector to disconnect the upper lubricator section from the lower section and raising said upper section and toolstring therein back to the floating vessel and lowering and reconnecting said upper section to the lower lubricator section as required, while performing wireline operations in the well;

(k) disconnecting the upper section from the lower section and raising the upper section and toolstring back to the floating vessel; and (l) disconnecting the lower section from the wellhead and lifting the lower section back to the floating vessel.

22. A method for conducting wireline operations in an underwater well comprising the steps of:

(a) placing a wireline tool string in an upper lubricator stack section, said section including a remotely operable section connector member, a remotely operable tool trap, one or more lubricator sections, a remotely operable flush valve connected high in said lubricator section, a remotely operable tool catcher, a remotely operable stuffing box and a remotely operable liquid chamber (b) passing a wireline through a vessel heave compensator on a floating vessel and said stuffing box and connecting said wireline to said tool string;

(c) connecting said upper section to a lower lubricator stack section, which includes a remotely operable section connector member, by connecting said remotely operable section connector members, said section connector including means responsive to internal lubricator stack pressure for locking said connector members connected, said lower section further including a remotely operable wellhead connector, a remotely operable blowout preventer, one or more lubricator sections, a remotely operated flush valve connected low in the lubricator section, a remotely operable fail close wireline blowout preventer;

(d) lowering the connected sections with a line and line winch from a floating vessel to an underwater wellhead;

(e) connecting the lower section to the wellhead;

(f) raising and lowering the wireline and toolstring with constant tensioning wireline winch means from the floating vessel to perform wireline operations in the well;

(g) remotely operating the remotely operable components in the lubricator stack and flushing the lubricator stack as required, while performing wireline operations in the well;

(h) bleeding pressure from the lubricator stack to unlock the section connector;

(i) remotely operating the lubricator section connector to disconnect the upper lubricator section from and reconnect said section to the lower lubricator section as required, while performing wireline operations in the well; and (j) disconnecting the lower section from the wellhead and lifting the connected lubricator sections back to the floating vessel.

23. The system of claim 1 wherein the upper lubricator stack section includes a liquid chamber having a conduit for conducting pressured fluid to said chamber.

24. A system for conducting wireline operations in an underwater well comprising:

(a) lubricator stack means, connectable to the wellhead and having a wireline tool string therein including a lower section having a remotely operable section connector member and means for connecting said lower section to a wellhead, an upper section including a remotely operable section connector member connectable to said lower section connector member, one or more lubricator sections and a remotely operable stuffing box;

(b) service unit means supported on the surface for raising and lowering said lubricator stack means and wireline tool string, including a source of pressured fluid; and (c) control conduits for conducting pressurized fluid from said source to said remotely operable section connector and stuffing box.

25. The system of claim 24 wherein the service unit means is supported by a floating vessel.

26. The sytem of claim 24 wherein the service unit means is supported by a platform.

* * * * *